US008682425B2

(12) United States Patent
Larsen et al.

(10) Patent No.: US 8,682,425 B2
(45) Date of Patent: Mar. 25, 2014

(54) ELECTROACUPUNCTURE SYSTEM

(75) Inventors: Adrian Larsen, Meridian, ID (US); Michael Walters, Baltimore, MD (US)

(73) Assignee: Miridia Technology Inc., Meridian, ID (US)

( * ) Notice: Subject to any disclaimer, the term of this patent is extended or adjusted under 35 U.S.C. 154(b) by 1072 days.

(21) Appl. No.: 12/022,808

(22) Filed: Jan. 30, 2008

(65) Prior Publication Data

US 2009/0192406 A1 Jul. 30, 2009

(51) Int. Cl.
*A61H 39/02* (2006.01)
*A61H 39/00* (2006.01)

(52) U.S. Cl.
CPC ..... *A61H 39/002* (2013.01); *A61H 2201/5061* (2013.01); *A61H 2230/65* (2013.01)
USPC ..... 600/548

(58) Field of Classification Search
USPC ..... 600/547, 548
See application file for complete search history.

(56) References Cited

U.S. PATENT DOCUMENTS

| | | | | |
|---|---|---|---|---|
| 3,971,366 | A * | 7/1976 | Motoyama | 600/384 |
| 4,016,870 | A | 4/1977 | Lock | |
| 4,180,079 | A | 12/1979 | Wing | |
| 4,556,064 | A * | 12/1985 | Pomeranz et al. | 607/66 |
| 5,224,469 | A * | 7/1993 | Mocny | 601/108 |
| 5,251,637 | A * | 10/1993 | Shalvi | 600/548 |
| 5,339,827 | A | 8/1994 | Masopust | |
| 5,366,483 | A * | 11/1994 | Sadkhin | 607/3 |
| 5,409,011 | A | 4/1995 | Alexeev et al. | |
| 5,482,038 | A * | 1/1996 | Ruff | 600/372 |
| 5,984,898 | A * | 11/1999 | Garvin | 604/195 |
| 6,808,499 | B1 * | 10/2004 | Churchill et al. | 600/587 |
| 7,074,217 | B2 * | 7/2006 | Strul et al. | 606/41 |
| 7,403,816 | B2 | 7/2008 | Ohkura | |
| 7,588,559 | B2 * | 9/2009 | Aravena et al. | 604/188 |
| 7,603,171 | B2 | 10/2009 | Eror et al. | |
| 7,693,579 | B2 * | 4/2010 | Hindinger et al. | 607/72 |
| 7,818,054 | B2 | 10/2010 | Fukumoto et al. | |
| 8,287,483 | B2 * | 10/2012 | Mitragotri et al. | 604/22 |
| 2001/0023359 | A1 * | 9/2001 | Grey et al. | 606/204 |
| 2003/0093070 | A1 * | 5/2003 | Strul et al. | 606/34 |
| 2004/0039296 | A1 * | 2/2004 | Szopinski | 600/547 |

(Continued)

FOREIGN PATENT DOCUMENTS

| | | | | |
|---|---|---|---|---|
| JP | 10033631 | A * | 2/1998 | A61H 39/02 |

OTHER PUBLICATIONS

AcuGraph® II product information brochure, 2006-2007, 4 pages, Miridia Technology, Inc., Meridian, Idaho.

(Continued)

*Primary Examiner* — Jeffrey G Hoekstra
*Assistant Examiner* — Michael C Stout
(74) *Attorney, Agent, or Firm* — Senniger Powers LLP

(57) ABSTRACT

An electroacupuncture system for measuring and treating meridian energy balance in a patient. The system can include a pressure sensitive probe and return path contact, both of which are connected to an electrical potential source. The probe and contact are meant to be applied to a patient to diagnose and treat meridian energy imbalances. The system also includes a processing apparatus connected to the electrical potential source capable of interpreting the readings taken by the electrical potential source and probe and affecting operation of the system based on the readings. The processing apparatus may also use measurements to calculate an overall meridian energy balance number.

14 Claims, 9 Drawing Sheets

(56) References Cited

U.S. PATENT DOCUMENTS

| | | | | |
|---|---|---|---|---|
| 2004/0087838 | A1* | 5/2004 | Galloway et al. | 600/300 |
| 2004/0230214 | A1* | 11/2004 | Donofrio et al. | 606/169 |
| 2004/0230256 | A1* | 11/2004 | Lin-Hendel | 607/72 |
| 2005/0015017 | A1* | 1/2005 | Horne et al. | 600/547 |
| 2005/0192510 | A1 | 9/2005 | Ohkura | |
| 2006/0074337 | A1 | 4/2006 | Yoo | |
| 2006/0106363 | A1* | 5/2006 | Aravena et al. | 604/506 |
| 2006/0212104 | A1* | 9/2006 | Hindinger et al. | 607/150 |
| 2006/0241719 | A1* | 10/2006 | Foster et al. | 607/45 |
| 2007/0078454 | A1* | 4/2007 | McPherson | 606/41 |
| 2007/0112348 | A1* | 5/2007 | Eggers et al. | 606/41 |
| 2007/0156040 | A1 | 7/2007 | Mouradian et al. | |
| 2008/0004621 | A1* | 1/2008 | Dahla et al. | 606/48 |
| 2008/0015460 | A1 | 1/2008 | Kanevsky et al. | |
| 2008/0015567 | A1* | 1/2008 | Kimura | 606/41 |
| 2008/0033504 | A1* | 2/2008 | Bertolucci | 607/46 |
| 2008/0234699 | A1* | 9/2008 | Oostman, Jr. et al. | 606/133 |
| 2009/0124924 | A1* | 5/2009 | Eror et al. | 600/547 |
| 2009/0163787 | A1* | 6/2009 | Mannheimer et al. | 600/324 |
| 2010/0094160 | A1 | 4/2010 | Eror et al. | |

OTHER PUBLICATIONS

Acutron Mentor product information, 11 pages, Microcurrent Research, Inc., Phoenix, Arizona, http://www.microlightresearch.com.

AcuSmith V 2.0 product information, 2 pages, Access Equipment Corp., http://www.chirocity.com.

ANTEL product information, 8 pages, AcuTech International Inc., http://www.acutechinternational.com.

CMD System overview and product manual, 11 pages, Computer Meridian Diagnostics, http://www.cmddiagnostics.com.

DigiMeridian Diagnosis System overview, 2001, 3 pages, MeriLogic Inc., Clarksville, Maryland, http://www.merilogic.com.

EMAS System product information, 2008, 18 pages, Health Epoch, Inc., http://www.emasweb.com.

EMI™ System product overview, 13 pages, Acu-International Supplies, Inc., Carefree, Arizona, http://www.emi4.com.

Insight Subluxation Station™ product information, 2008, 12 pages, Chiropractic Leadership Alliance, Mahwah, New Jersey, http://www.subluxation.com.

Larsen, Adrian P., "Ryodoraku History and Research", 6 pages.

M.E.A.D. (Meridian Energy Analysis Device) product overview, 2004, 9 pages, MedPex Enterprises Ltd., Taipei, Taiwan, http://www.mdpex.com.

Mens-O-Matic IV-A product description, 2006, 2 pages, Monad Corporation/Electro-Tech Products, Inc., Glendora, California, http://www.monadcorp.com.

PROGNOS diagnostic system product information, 2003, 14 pages, MedPrevent GmbH, Waldershof, Germany, http://www.medprevent.de.

USPTO, Non-Final Office Action for U.S. Appl. No. 12/778,222 dated Mar. 2, 2012, 19 pages.

* cited by examiner

ELECTROACUPUNCTURE SYSTEM

BACKGROUND OF THE INVENTION

This invention relates generally to a system and method used to non-invasively measure and balance the electrical skin resistance of a human or animal subject.

In general, the purpose of acupuncture is to balance a patient's life energy. This life energy is also known to those skilled in the art as "Chi". This balance is accomplished by redirecting the body's energy through points located throughout the body on the skin surface. The lines connecting these points form meridians which connect to the body's internal organs.

In 1951 Dr. Yoshio Nakatani presented his theory on Ryodoraku acupuncture. This theory included discovery of the existence of a series of low electrical skin resistance points running up and down the body. When linked, these points matched with the classical Chinese acupuncture meridians of the body. By measuring and electrically stimulating these points, Dr. Nakatani theorized that results similar to those obtained in traditional acupuncture could be realized. The advantages of Ryodoraku acupuncture are that it is non-invasive and can be performed in a much shorter period of time than traditional acupuncture.

The Ryodoraku method is performed by measuring the resistance of the energy meridians as reflected by electrical skin resistance. Through a determination of the resistance of each of the meridians, areas of over-excitement or under-excitement can be located. Once energy levels are determined, a treatment regimen is determined and electrical current is applied to bring the meridians into balance. This process is also known as "electroacupuncture" and has the stated purpose of balancing the patients "Chi".

Prior art electronic acupuncture or electroacupuncture devices are largely self-contained, making them extremely bulky and awkward to work with. Further, in galvanic skin resistance testing one of the factors confounding accurate measurements is the amount of pressure exerted against the skin by the measurement device. Increases in pressure tend to produce a proportional decrease in resistance. Without careful control of measurement pressure, accurate readings are difficult to obtain.

Some probes on the market (EMAS, MEAD, Jade) attempt to overcome this problem by using a mechanical arrangement incorporating a spring-loaded probe. The spring loaded probe will only make electrical contact when the spring is compressed sufficiently. This arrangement does not measure actual pressure but instead relies on the spring to ensure that greater than a certain minimum pressure is applied to the patient's skin. The pressure range cannot be adjusted or set, and no feedback is provided to the user.

SUMMARY OF THE INVENTION

One aspect of the present invention is directed to an electroacupuncture system comprising a source of electrical potential and a probe electrically connected to an electrical potential source and constructed for selectively contacting skin and applying electrical potential to the skin. The probe comprises a plunger arranged to receive the force applied to the skin when the probe contacts the skin, and a sensor for measuring the force received by the plunger and providing a signal indicative of the force measured.

Another aspect of the present invention is directed to an electroacupuncture system comprising a source of electrical potential, a probe electrically connected to the electrical potential source constructed for selectively contacting skin and applying an electrical potential to the skin, and a processing apparatus in communication with the probe and electrical potential source. The processing apparatus is adapted to periodically calculate the electrical resistance of the skin while an electrical potential is being applied to the skin, and to cease application of the electrical potential when a predetermined electrical resistance of the skin is reached.

Yet another aspect of the present invention is directed to an electroacupuncture system comprising a source of electrical potential, a probe electrically connected to the electrical potential source and constructed for selectively contacting the skin of a living body and applying electrical potential to the skin, and a processing apparatus in communication with the probe and the electrical potential source. The processing apparatus is adapted to periodically calculate electrical resistance of the skin while the electrical potential is being applied to the skin. The processing apparatus is further adapted to store calculated electrical resistance measurements for acupuncture meridians on the body and includes a program which uses the stored electrical resistance values to calculate an energy balance number. This energy balance number is indicative of the variance of skin resistance measurements at the meridians. The processing apparatus also includes an output device for conveying the calculated balance number to both the patient and the operator.

In a further aspect of the present invention, a method of determining an acupuncture meridian energy balance number for a patient generally comprises acquiring electrical resistance values for multiple meridian locations on the body by applying an electric potential to the patient at the locations and measuring the resistance of the patient's skin at the locations. The acquired resistance values are compared to at least one of: (a) other acquired resistance values and (b) stored desired meridian resistance values. A meridian energy balance number is determined by assigning scores to results of the comparisons and combining the scores.

Other features of the invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
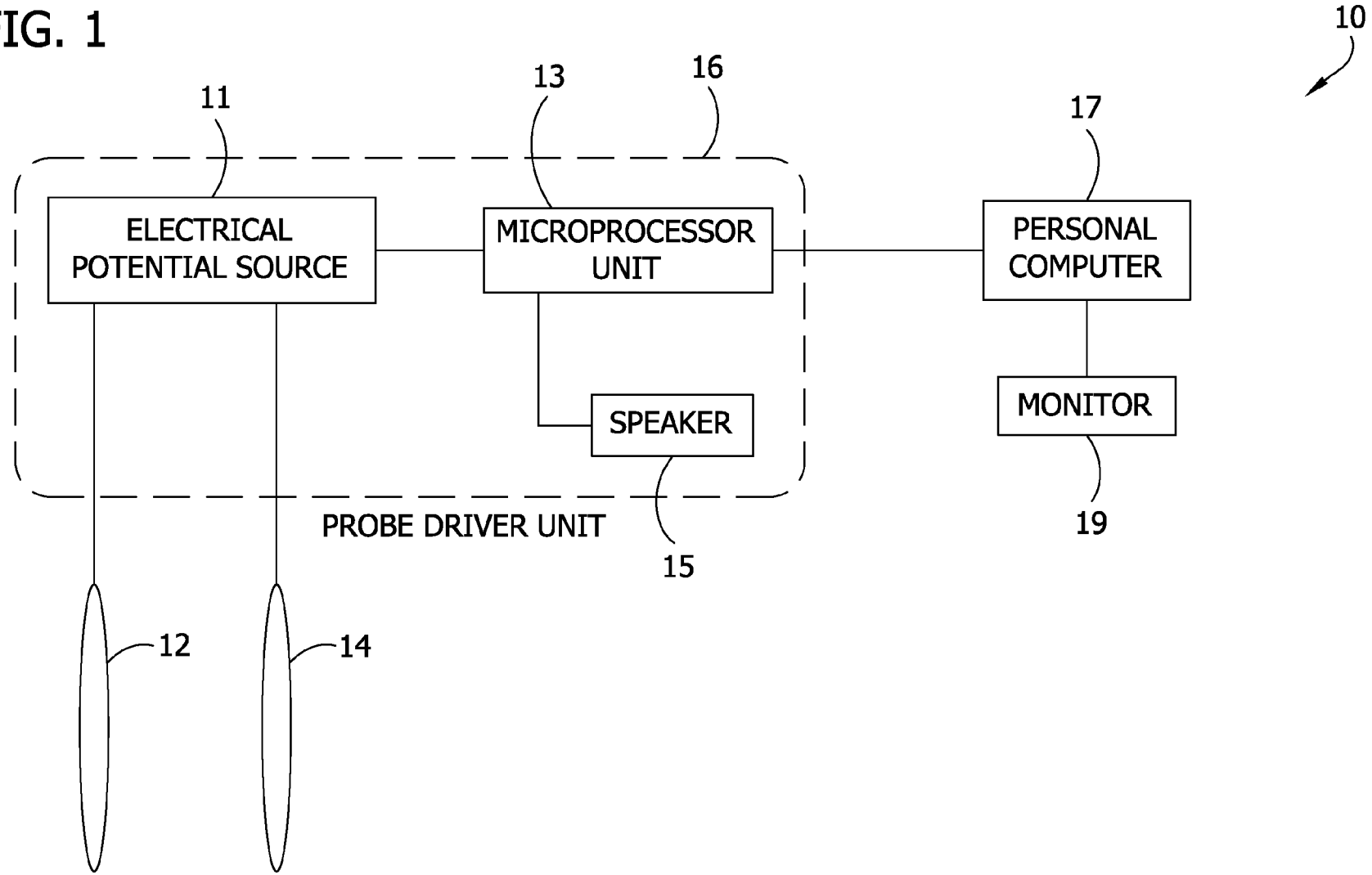
FIG. 1 is a diagram of all of the components of the device and the connections running between them.
Figure 2:
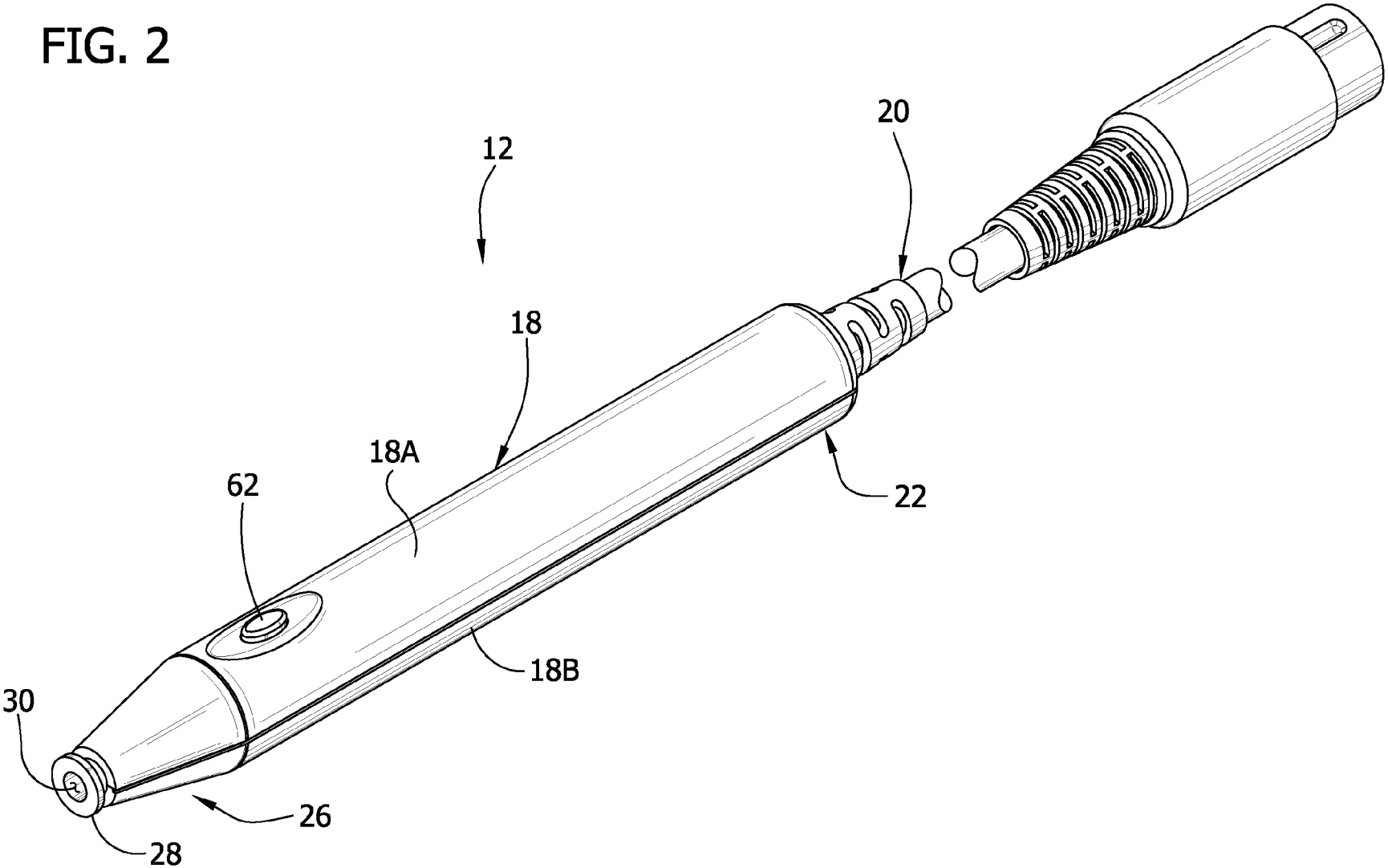
FIG. 2 is a perspective of the first hand-held apparatus.

Referring now to the drawings, and in particular to FIG. 1, a device for diagnosing and balancing the meridian energy levels of a patient through the use of non-invasive electroacupuncture is generally indicated at 10. While the present embodiment is directed to treatment of a human patient, it is understood that other embodiments capable of treating animals do not depart from the scope of the invention. The device comprises a probe (broadly a first hand-held apparatus), generally indicated at 12, a return path grip (broadly a second hand-held apparatus or return path contact), generally indicated at 14, a probe driver unit generally indicated at 16, a monitor 19, and a personal computer generally indicated at 17. The probe driver unit 16 comprises an electrical potential source 11, a microprocessor unit 13, and a speaker 15.

Figure 3:
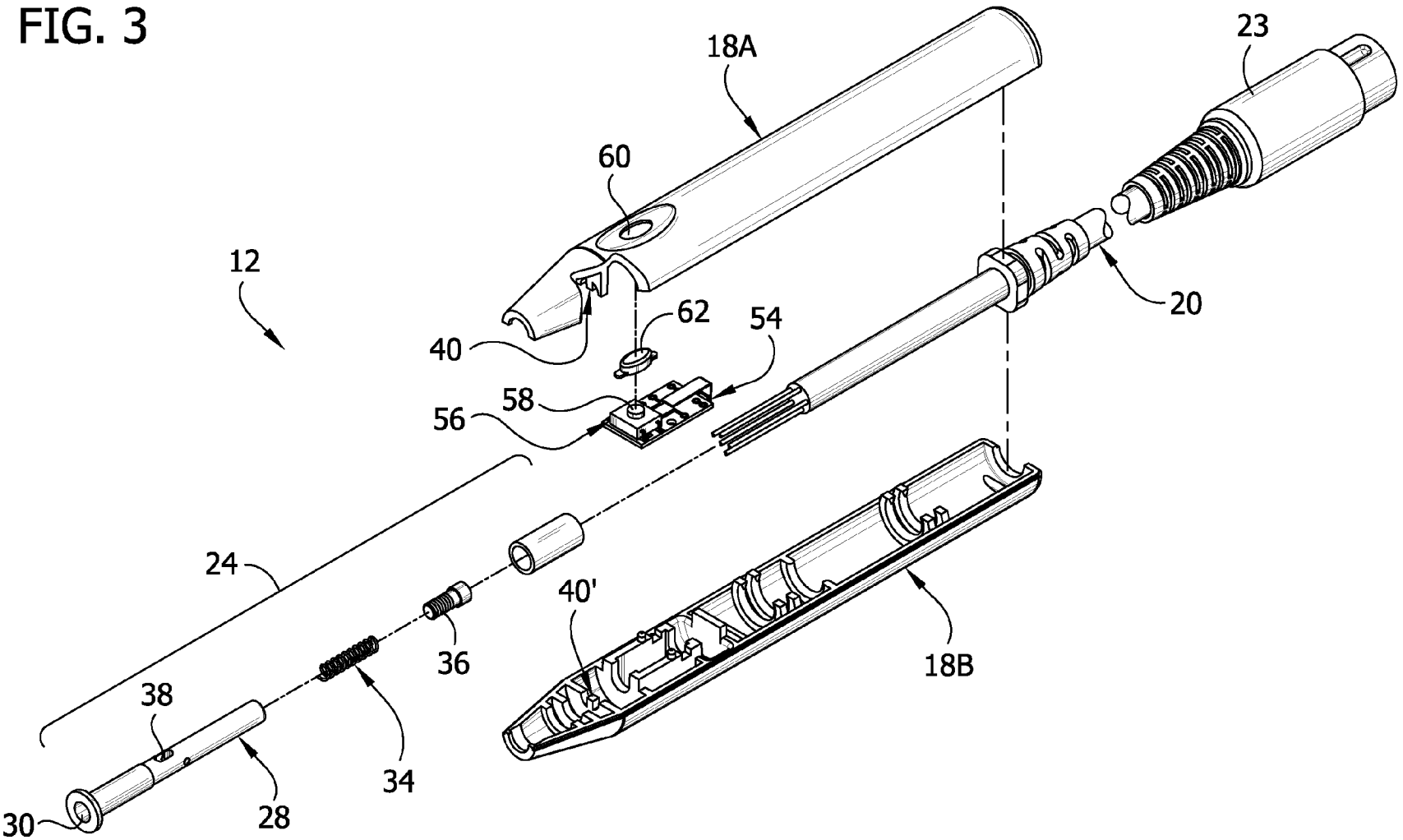
FIG. 3 is an exploded perspective of the first hand-held apparatus.
Figure 4:
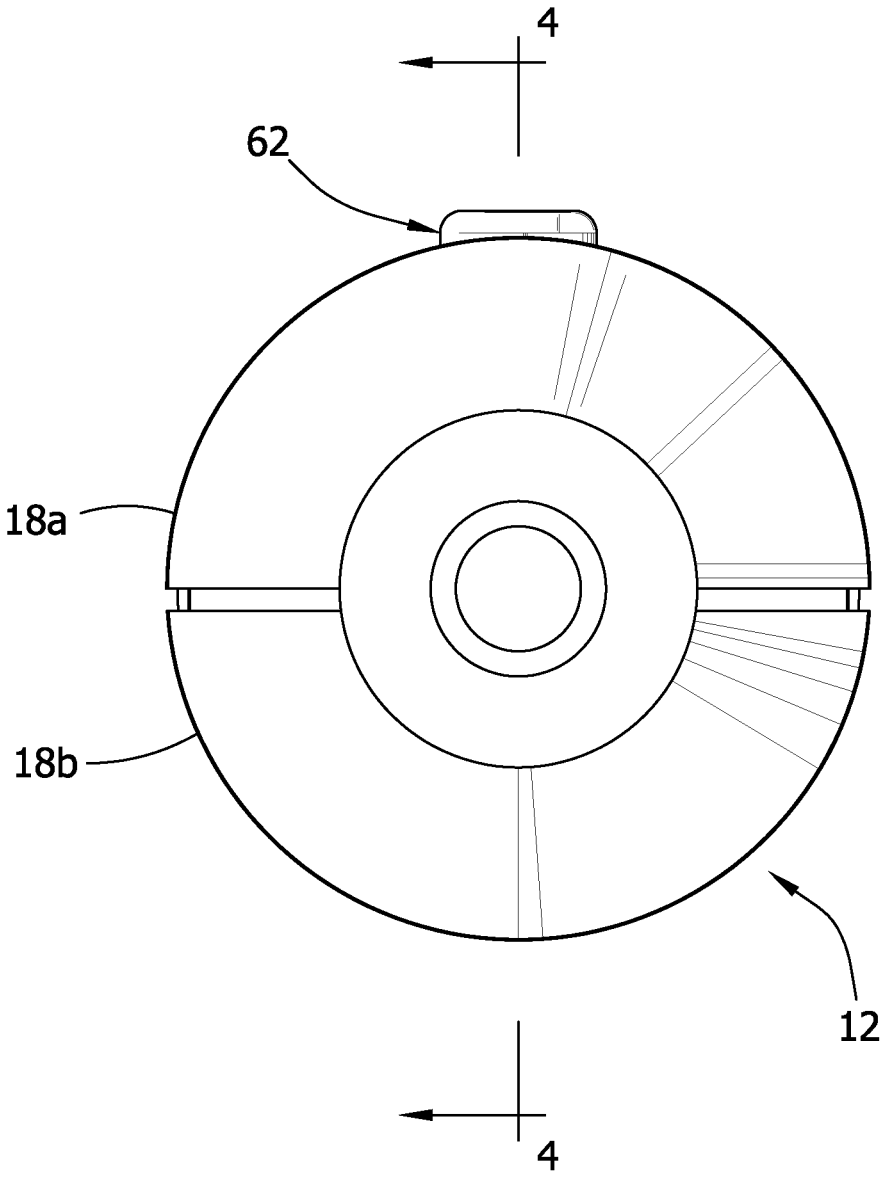
FIG. 4 is a front elevation of the first hand-held apparatus.
Figure 5:
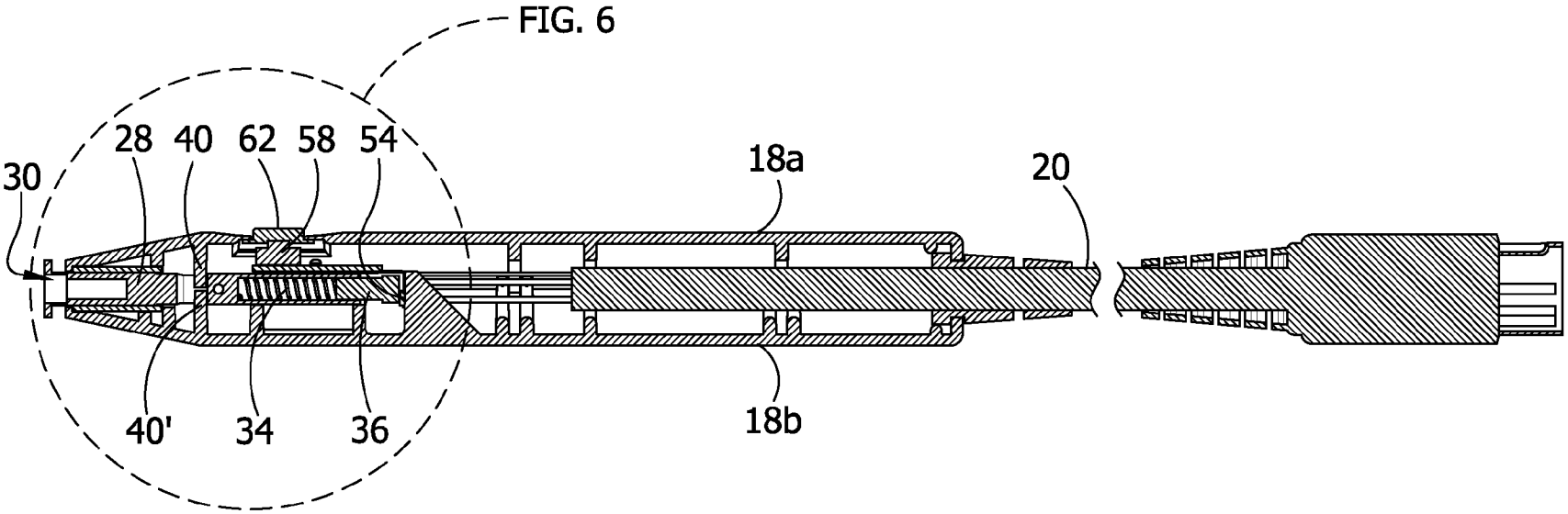
FIG. 5 is a section taken in the plane including line 5-5 of FIG. 4.

Referring to FIG. 3, the first hand-held apparatus includes an upper casing 18*a* and lower casing 18*b* that, when mated, form a generally cylindrically shaped housing 18 much like the shape of a pen. The terms "upper", "lower", and similar orientation terms are used for convenience and do not mandate any particular orientation or position. A cable 20 is connected to the back end 22 of the housing 18 and provides communication between the first hand-held apparatus 12 and the probe driver unit 16. A plug 23 on the cable 20 provides releasable connection to the probe driver unit 16. A plunger assembly, generally indicated at 24, is mounted within the front end 26 of the housing 18 and partially protrudes from the front end of the housing.

Figure 6:
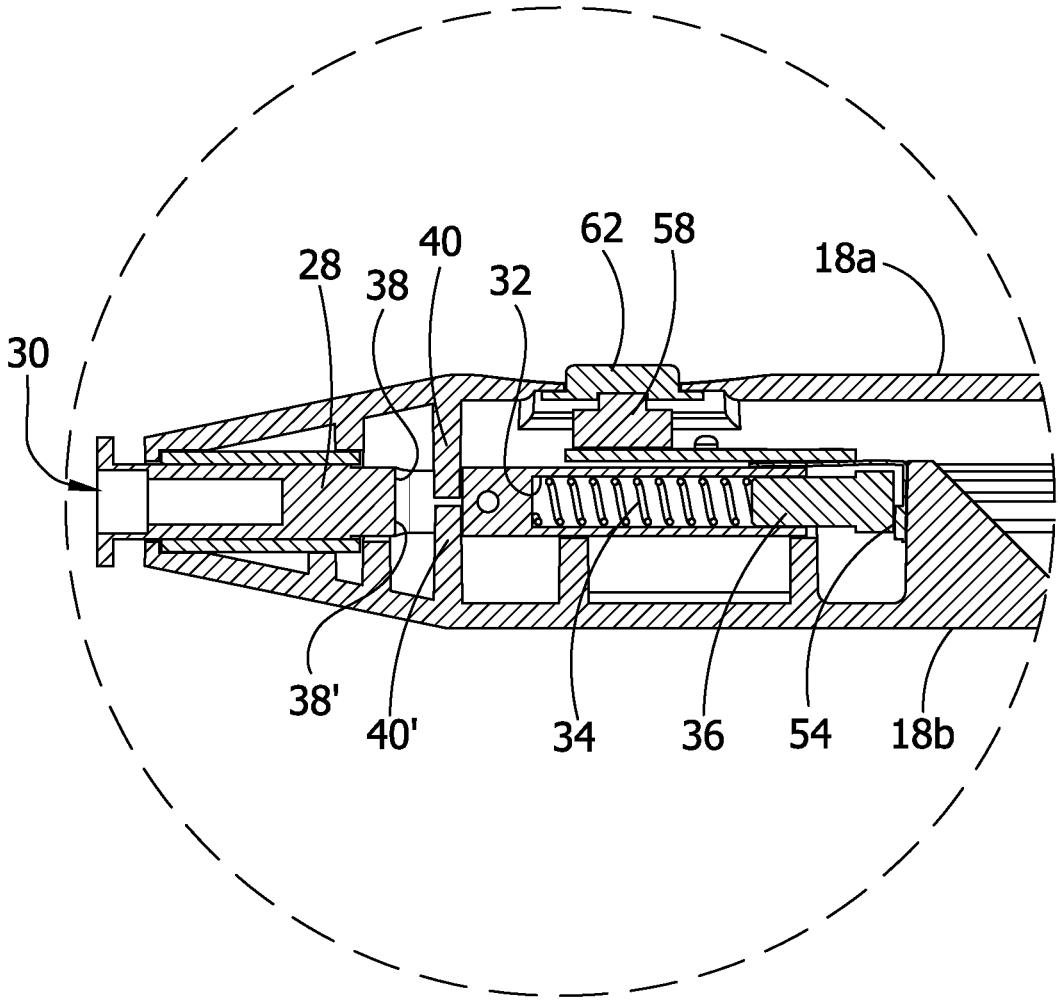
FIG. 6 is an enlarged detail of the portion of the first hand-held apparatus indicated in FIG. 5.

The probe assembly 24 includes a cylindrically shaped plunger 28 that has a receptacle opening 30 at its distal end which functions as a mounting aperture for insertion of interchangeable probe tips (not shown). Referring to FIG. 6, the rear section of the plunger 28 has an axially extending cavity 32, a compression spring 34 and, axially behind the spring, a plug 36 slidably received into the cavity and engaging the spring. The plunger 28 includes two elongated slot openings 38 and 38' respectively, located on the top and bottom of the plunger. The slot openings 38, 38' are opposite ends of a slot that extends transversely through the plunger. These top and bottom slot openings receive top and bottom housing fingers 40 and 40' respectively. In the illustrated embodiment, the fingers are formed as one piece with the housing. By extending into the slot openings 38 and 38' of the plunger 28, the housing fingers 40 and 40' hold the plunger 28 from rotating about its primary axis and also limit the longitudinal travel of the plunger 28 relative to the housing 18.

The compression spring 34 is enclosed entirely within the rear cavity 32 of the plunger 28 and is arranged such that the primary axis of compression of the spring is coaxial with the plunger. The first end of the compression spring 34 rests against the forward-most interior surface of the rear cavity 32 of the plunger 28 while the second end of the compression spring rests against the forward-most surface of the plug 36.

The plug 36 extends into the rear cavity 32 of the plunger and longitudinally slides within the rear cavity as the plunger 28 moves relative to the housing 18 and plug. The plug 36 comprises two cylindrical sections; one radially smaller cylindrical portion which slidably engages the interior of the rear cavity 32 of the plunger and one radially larger cylindrical portion of a larger diameter than the diameter of the rear cavity, which acts a stop, and resists insertion of the plug into the rear cavity of the plunger past a certain depth. The back most surface of the plug 36 contacts a force sensor 54.

The force sensor 54 is mounted (e.g. as by gluing) on the lower casing 18*b* of the housing 18 so that the detection surface of the sensor is parallel to the rearmost surface of the plug 36. The force sensor 54 is in electrical communication with the probe driver unit 16 through the cable 20 connected to the back end of the housing 22. The force sensor, Model No. SF-2, used in the illustrated embodiment is manufactured by CUI Incorporated of Beaverton, Oreg. It will be understood that other force sensors may be used without departing from the scope of the present invention.

In one embodiment, the probe 12 also incorporates a switch assembly generally indicated at 56. This switch assembly is mounted on the interior of the housing 18 together with the force sensor 54. The switch assembly 56 comprises a two position switch 58 in electrical communication with the probe driver unit 16 through the cable 20. The switch 58 is aligned with a hole 60 in the exterior surface of the upper housing 18*a*. A rubber probe button 62 extends through the hole 60 and essentially closes the hole 60. This rubber probe button 62 shields the switch 58 and interior of the probe 12 from dirt and moisture while allowing the device operator to toggle the switch 58 between the two available positions.

The return path grip 14 provides an electrical return path for the treatment and diagnostic currents being administered by the probe. One embodiment of this return path grip 14 is a metal bar electrically connected to the probe driver unit 16 via an electrical cable 64. The return path grip 14 is held in the patient's hand during diagnosis and treatment. Any suitable way of completing the circuit may be used within the scope of the present invention. Another embodiment of the return path connection may comprise an electrically conductive contact applied directly to the human or animal patient's skin and electrically connected to the probe driver unit 16 by an electrical cable 64.

The probe driver unit 16 is generally shown in FIG. 1. This probe driver unit 16 is in electrical communication with the probe 12 and return path grip 14, and also communicates with the personal computer 17 via a cable supporting USB communication or any other means known in the art. The probe driver unit 16 is powered via an electrical cord (not shown) configured to electrically connect to a standard electrical outlet. The apparatus may be powered in other ways, such as by batteries or other power sources, without departing from the scope of this invention.

The probe driver unit 16 comprises two main functional components, an electrical potential source 11 and a microprocessor unit 13. The electrical potential source 11 is responsible for generating the current and voltage necessary for patient treatment and diagnosis. The microprocessor unit 13, also located within the probe driver unit 16, handles communications between the probe driver unit and the personal computer 17, and calculates skin resistance values during treatment and diagnosis. Treatment parameters are sent to the microprocessor unit 13 by the personal computer 17 via USB communication while patient data being calculated by the microprocessor unit, including skin resistance, is sent to the personal computer via the same USB connection. The microprocessor unit 13 controls the electrical potential source 11 and commands it to generate specific currents and voltages.

The microprocessor unit 13 includes an audible feedback capability which provides cues to the operator during diagnostic examinations and treatments. The audio signal generated by the microprocessor unit is broadcast via the speaker 15. Audible signals assist the operator in locating the precise acupuncture meridian points to be examined or treated. The pitch of the tone produced by the microprocessor unit is increased or decreased depending upon the skin resistance readings it measures.

In the illustrated embodiment, the microprocessor unit 13 and the personal computer 17 constitute a processing apparatus. The processing apparatus is responsible for commanding voltage and current during diagnosis and treatment, calculating and monitoring patient skin resistance during treatment, and storing patient data for review. The personal computer 17 and microprocessor unit 13 are not contained within the same physical enclosure, but it is understood that they could be without departing from the scope of the invention. It is further understood that the electrical potential source, microprocessor unit, speaker, personal computer, and monitor elements of the present invention can take on a variety of different physical arrangements without departing from the scope of the invention. For example, the microprocessor unit 13 and personal computer 17 could be physically collocated and would still be considered a processing apparatus. Likewise, the electrical potential source 11, microprocessor unit 13, speaker 15, personal computer 17, and monitor 19 may all be combined into a single apparatus, also without departing from the scope of the present invention.

The speaker 15 and monitor 19 of the current embodiment are each examples of what is referred to as an output device. These output devices are responsible for communicating information to the operator and patient before, during, and after diagnosis and treatment. It is to be indicated that only one output device or more than two may be provided within the scope of the present invention.

The personal computer 17 typically has at least some form of computer readable media. Computer readable media, which include both volatile and nonvolatile media, removable and non-removable media, may be any available medium that may be accessed by the personal computer 17. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. For example, computer storage media include RAM, ROM, EEPROM, PROM, flash memory or other memory technology, CD-ROM, digital versatile disks (DVD) or other optical disk storage, magnetic cassettes, magnetic tape, magnetic disk storage or other magnetic storage devices, or any other medium that may be used to store the desired information and that may be accessed by the personal computer 17. Communication media typically embody computer readable instructions, data structures, program modules, or other data in a modulated data signal such as a carrier wave or other transport mechanism and include any information delivery media. Combinations of any of the above are also included within the scope of computer readable media.

At least one embodiment of the invention may be described in the general context of computer-executable instructions, such as program modules or software subsystems, executed by one or more computers or other devices. The computer-executable instructions may be organized into one or more computer-executable components or modules including, but not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

Further, the order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Figure 8:
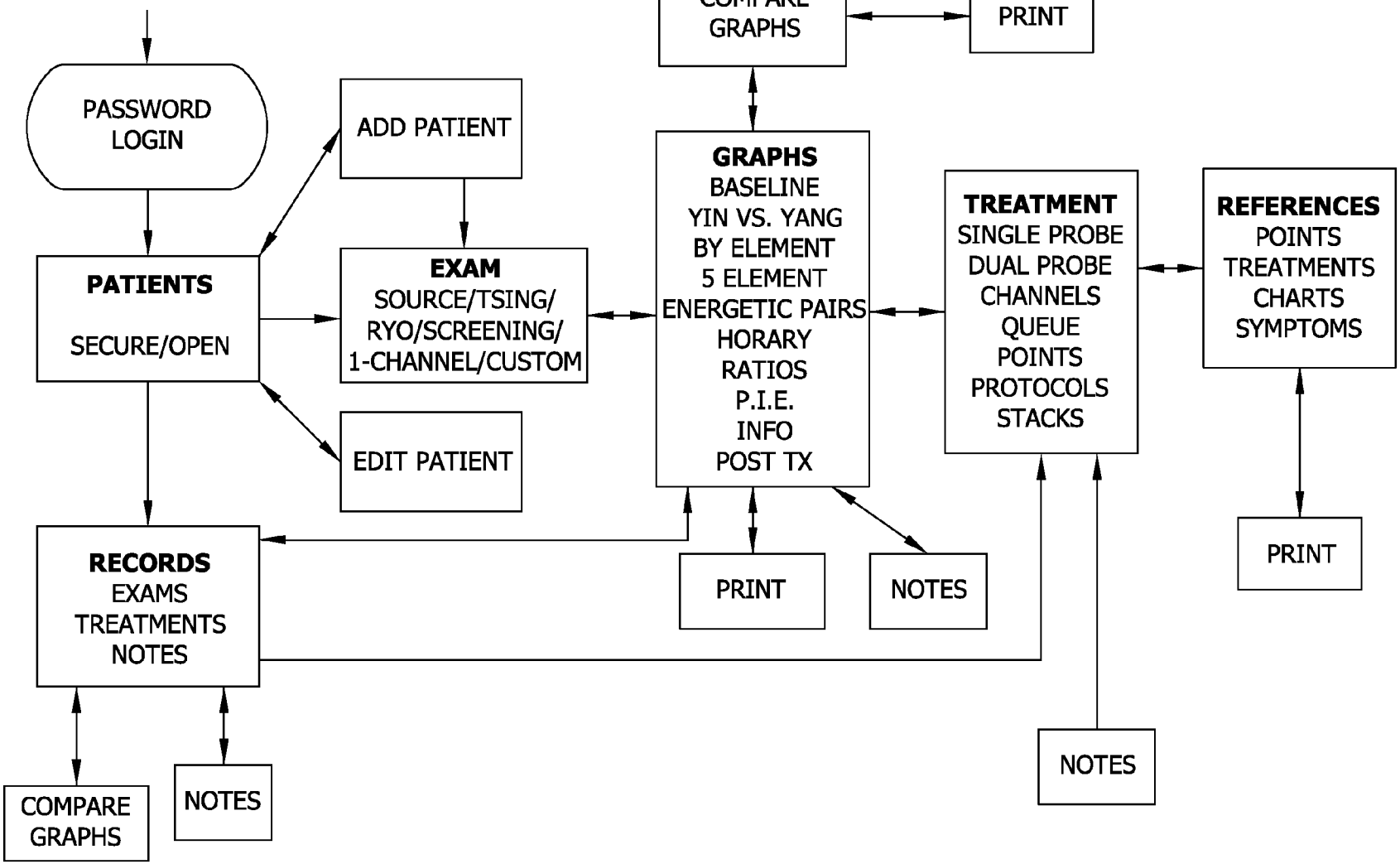
FIG. 8 is a graphical representation of the general operational scheme of the computer software.

Treatment is initiated via software running on the personal computer 17. FIG. 8 provides the general operational scheme of the software. The operator first enters login information and is taken to the main patient screen where the operator may, among other things, add new patients and review old patient records. Once the operator is satisfied that the appropriate patient information is loaded into the software, the operator will then move to the exam step in which he or she measures the Ryodoraku meridian point resistance at a variety of predetermined locations around the body. The location of each Ryodoraku meridian point is well known in the art. The purpose of the diagnostic is to determine the pre-treatment or baseline state of the patient. The software running on the personal computer records the resistance values at each location and directs the operator to the next measurement point. Once the patient's baseline has been established, the software will graph the pre-treatment or baseline state of the patient in a variety of ways. This list includes: Yin vs. Yang, By Element, 5 Element, Energetic Pairs, Horary, Ratios, Personal Integrated Energetics ("P.I.E."), and others.

Figure 7:
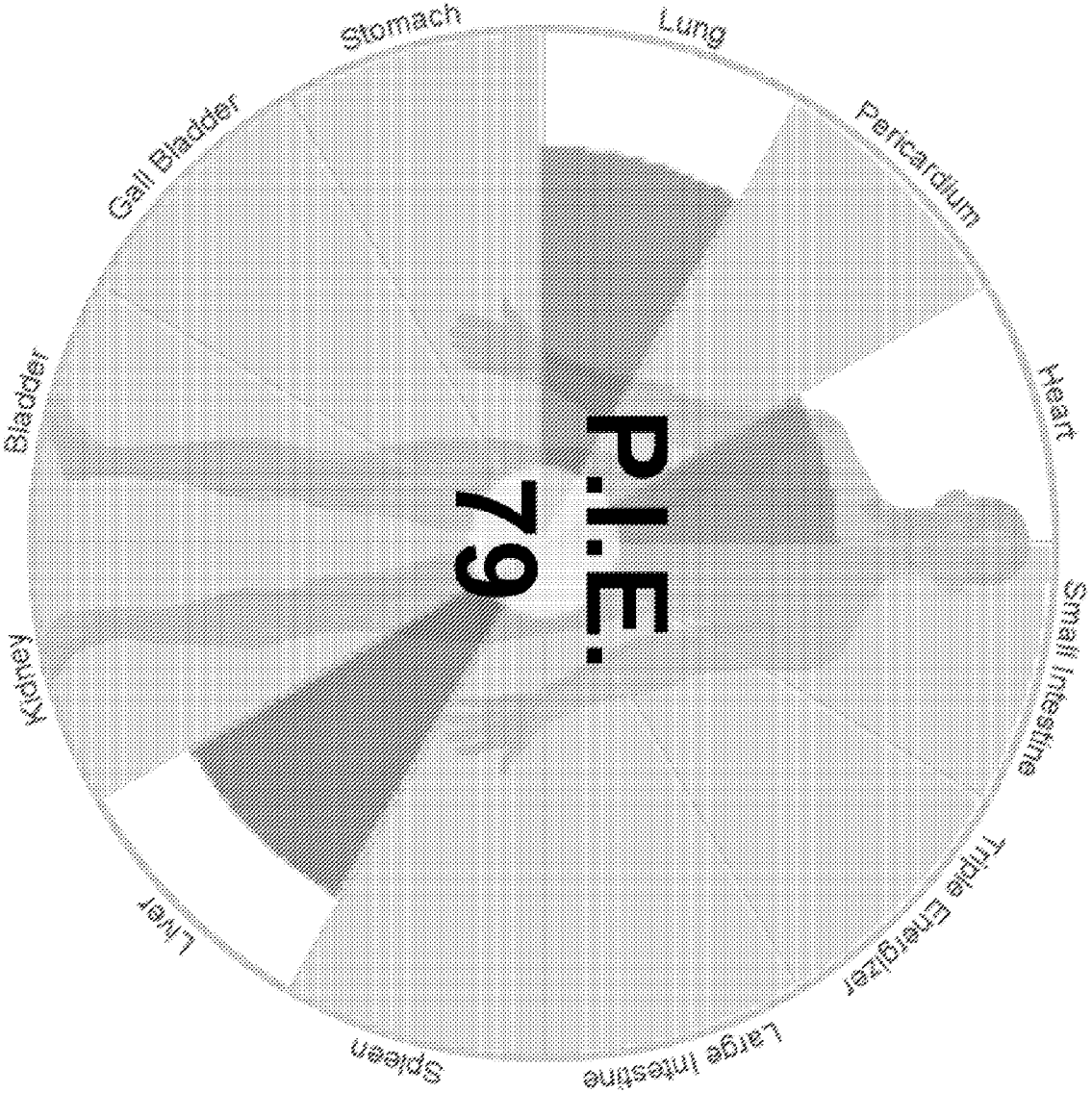
FIG. 7 is a sample P.I.E. graph generated by software running on the personal computer.

Referencing FIG. 7, the P.I.E. graph, for example, is one of the ways in which collected exam data is displayed to the operator and communicated to the patient. This graph will show a circle with a semi-transparent person in the middle, pie slices going out, each representing a meridian, and shading based on the imbalances in each meridian. If the meridian is "Normal," the shading will go all the way to the perimeter of the circle. If the meridian is deficient or excessive, the shading will be proportionally reduced, by the distance from the mean (either above or below.) Both excessive and deficient readings will reduce the shading in the circle. Each of these shaded regions can be colored to further communicate a patient's meridian imbalance. The point of this display is to demonstrate to the patient that there is an imbalance in the meridian, and to give an idea of the severity of the imbalance. Additionally, statistical methods will be used to analyze the imbalances noted and distill them into a single number, reflecting the overall level of imbalance and therefore the overall health of the patient. This single number will be presented on a scale from 1-100, with the higher numbers reflecting better energetic integration.

The level of imbalance measured in the patient is calculated using the following technique:

First, 24 measurements of skin resistance (12 meridians, left and right measurement on each meridian) are taken. These measurements are scaled proportionally to a scale of 0-200, with 200 being the lowest resistance and 0 being the highest resistance. This method is well known in the art. The PIE score begins at 100 and subtractions are made for each observed imbalance. A "Split" is defined as a statistically significant difference between the readings on the left and right sides of the same meridian. Each Split incurs a penalty based on the magnitude of the difference between the left and right side readings. Splits of 25 or more incur a 4 point penalty; 36 or more incur a 5 point penalty and splits of 51 or more incur a 6 point penalty. Every split incurs a penalty against the 100 point PIE score Next, excessive and deficient resistance levels incur penalties against the PIE score. Readings are categorized as excessive or deficient based on their distance from the mean of the 24 readings. Farther from the mean incurs a greater penalty as follows:

| Distance from Mean | Penalty |
|---|---|
| 16-24 | 1 |
| 25-29 | 2 |
| 30-34 | 3 |
| 35-44 | 4 |
| 45+ | 5 |

Next, penalties (or "scores") are assigned for other statistical measurements. If the mean of the 24 measurements is excessively high or excessively low, penalties are incurred. Excessively high or low is defined by distance from the normal range of 85-115 (a stored desired electrical resistance value). Therefore a mean of 116 is considered 1 point outside the normal range. Penalties are as follows:

| Distance from Normal Range | Penalty |
|---|---|
| 1-9 | 2 |
| 10-14 | 4 |
| 15+ | 8 |

Penalties are next assigned for poor stability scores. The stability score is calculated by the following equation:

$$(1-((\text{Highest reading}-\text{lowest reading})-(0.3*\text{mean}))/200))*100.$$

This equation returns a stability score between 0 and 100. Penalties are as follows:

| Stability Score | Penalty |
|---|---|
| 0-49 | 8 |
| 50-59 | 6 |
| 60-69 | 5 |
| 70-79 | 4 |
| 80-89 | 2 |
| 90-94 | 1 |
| 95+ | 0 |

Penalties are next assigned for imbalances between Yin and Yang meridians. Every meridian is classified as either Yin or Yang in classical Chinese acupuncture teachings. Six of the twelve are "Yin" and the other six are "Yang." Yin/Yang balance is calculated according to a formula. Yin mean is calculated by adding all yin meridian readings and dividing by 12. Yang mean is calculated in the same way, using yang meridian readings. The lesser mean is divided by the greater mean and the dividend is subtracted from 100 to arrive at a yin/yang imbalance percentage. Penalties are assigned as follows:

| Yin/Yang Imbalance | Penalty |
|---|---|
| 0-9 | 0 |
| 10-14 | 3 |
| 15-19 | 6 |
| 20-24 | 7 |
| 25+ | 8 |

Penalties are next assigned for imbalances between "hand" and "foot" meridians. Every meridian is classified as either "hand" or "foot" in classical Chinese acupuncture teachings, based on where the meridian is located on the body. Six of the twelve are located on the arm or upper extremity and the other six are located on the leg or lower extremity. Upper/lower balance refers to location, rather than reading. In other words, "Upper" readings are the readings taken on the upper extremity, not necessarily the highest of the readings collected. Upper/Lower balance is calculated according to a formula. Upper mean is calculated by adding all upper meridian readings and dividing by 12. Lower mean is calculated in the same way, using lower meridian readings. The lesser mean is divided by the greater mean and the dividend is subtracted from 100 to arrive at an upper/lower imbalance percentage. Penalties are assigned as follows:

| Upper/Lower Imbalance | Penalty |
|---|---|
| 0-9 | 0 |
| 10-14 | 3 |
| 15-19 | 6 |
| 20-24 | 7 |
| 25+ | 8 |

Penalties are next assigned for imbalances between meridians on the left and right sides of the body. The left/right balance is calculated according to a formula. Left mean is calculated by adding all left meridian readings and dividing by 12. Right mean is calculated in the same way, using right meridian readings. The lesser mean is divided by the greater mean and the dividend is subtracted from 100 to arrive at a left/right imbalance percentage. Penalties are assigned as follows:

| Left/Right Imbalance | Penalty |
|---|---|
| 0-9 | 0 |
| 10-14 | 4 |
| 15-19 | 6 |
| 20-24 | 7 |
| 25+ | 8 |

All penalties accrued from all the above calculations are added together and subtracted from 100 to arrive at a PIE score. If there are no penalties incurred, the PIE score will be 100, indicating that all measurements fall within acceptable parameters. Scores lower than 100 demonstrate the aggregate degree to which the measurements deviate from acceptable parameters. The purpose of this PIE number is to give a numerical reflection of the overall meridian energy balance in the patient.

The operator, having analyzed the patient's baseline state, will then prescribe a series of treatments based upon the patient's individual meridian imbalances. These treatments are placed into a queue using software running on the personal computer. Once the list of treatments has been compiled, the operator begins treatment at the first point in the queue and proceeds point by point, following instruction provided by the software for each treatment point. During treatment, the software receives resistance readings from the microprocessor unit 13 that are displayed on the monitor 19 and records these readings for post-treatment review.

As outlined above, the device of the present invention has two modes of operation, a diagnostic mode and a treatment mode. During the diagnostic mode, a current substantially lower than that used in the treatment mode is applied and is used to measure the resistance of the patient's skin at various locations as dictated by electroacupuncture methods. This process of diagnosis, and the locations on the body at which diagnosis is to be performed, are well known in the art. During the treatment mode, a current substantially higher than that used during the diagnostic mode is employed to actually alter the resistance of the patient's skin at various locations. The voltage and current required to treat these locations is determined by the software. These voltage and current requirements are transmitted to the microprocessor unit where they are generated. The voltage and current requirements conform to the teachings of electroacupuncture methods and are well known in the art.

The probe 12 dynamically measures the force placed against the skin by the plunger assembly 24 during measurement. This measurement is reported to the software on the personal computer 17 and feedback is provided to the operator in the form of audio indication (via speaker 15) of the correct pressure, and visual indication that the pressure is in the correct range for measurement. The software can be set to disable measurement functionality until the probe assembly pressure is in the correct range, thus preventing any possibility of erroneous measurements. Operators who wish to adjust the pressure range for measurement may do so via the software. Those who wish to turn off the pressure sensing mechanism all together can do so via the software interface, rendering the probe 12 a standard, non-pressure sensing probe.

During normal human treatment operation, the patient holds the return path grip 14 in one of his hands while the device operator applies the tip of the probe 12 to a prescribed Ryodoraku meridian point. If the patient is an animal, a return path contact (not shown) is attached conductively to the patient's skin. A low diagnostic current is transmitted from the electrical potential source 11 inside the probe driver unit 16, through the cable 20 and plunger assembly 24, and is applied to the skin of the patient. This current then runs through the patient's body from the location of the tip of the probe 12 to the return path grip 14. This current is then routed back through the cable attaching the return path grip 14 to the probe driver unit 16 and is measured by the electrical potential source 11. This information is transmitted from the electrical potential source to the microprocessor unit 13 which then uses the voltage and current being applied to the patient to calculate a resistance value which is transmitted back to the personal computer 17 for displaying to the operator on monitor 19.

As the operator presses the tip portion of the probe 12 against the skin of the patient, the plunger 28 extends further inside the housing 18 of the probe 12 and compresses the spring 34, which in turn applies more force to the plug 36 and force sensor 54. The force measured by the force sensor 54 is then transmitted back to the probe driver unit 16 via the cable 20, and ultimately is communicated by the microprocessor unit 13 to the personal computer 17. The personal computer displays this information for viewing by the operator and/or patient.

The operator will use the resistance and force values being relayed to him or her via the personal computer 17, speaker 15, and monitor 19 to position the tip of the first hand-held apparatus 12 so that it is resting on the acupuncture meridian point to be treated. This is accomplished by applying a constant force to the patient's skin and moving the probe tip around the appropriate meridian point until the precise location of lowest skin resistance is found. Once the operator has the tip positioned properly, the operator then presses the probe button 62, activating the switch 58, signaling the microprocessor unit 13 to instruct the electrical potential source 11 to increase the current flowing to the first hand-held apparatus 12 from the lower diagnostic current to the higher treatment current.

While the treatment current is being applied to the patient, the microprocessor unit 13 continues to calculate the resistance of the patient's skin by using the known current and voltage being applied. This information is continuously relayed back to the personal computer 17 during the treatment cycle. The software on the personal computer 17 tracks this change in resistance and, when the resistance reaches a predetermined level, terminates the treatment cycle by sending instructions back to the microprocessor unit 13 which in turn commands the electrical potential source 11 to cease generation of treatment currents.

Figure 9:
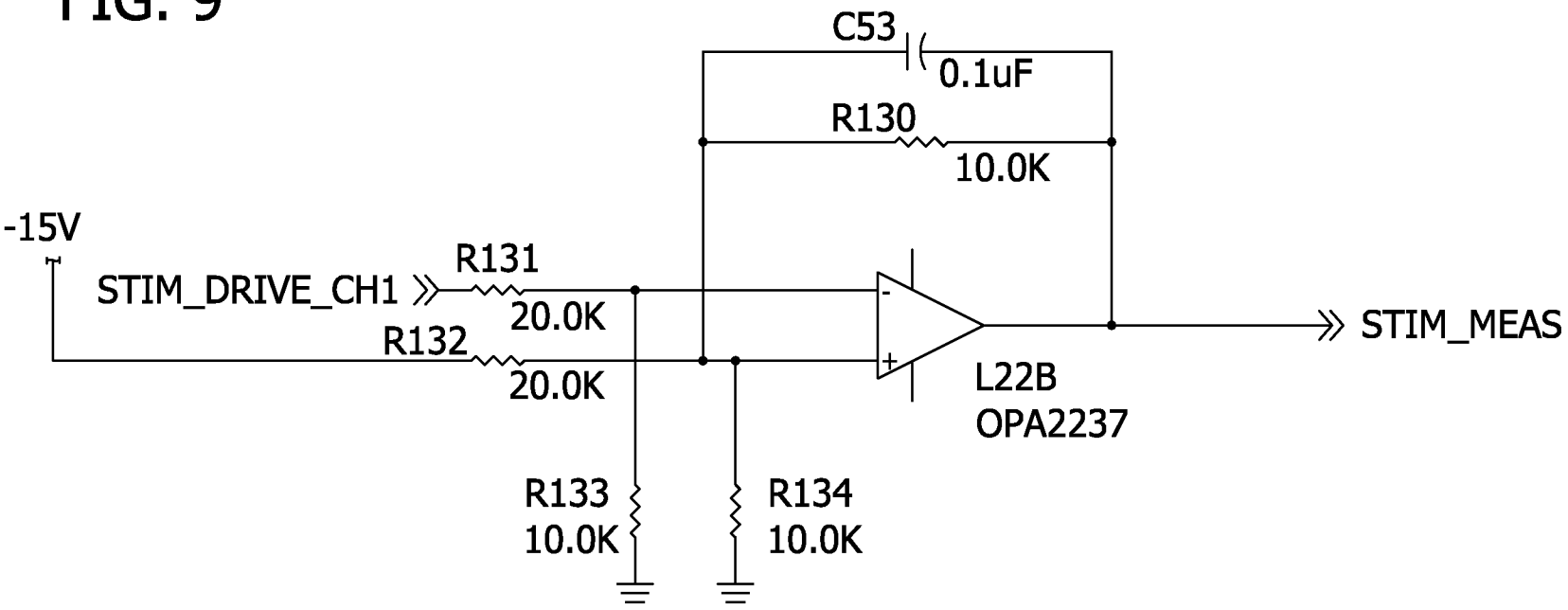
FIG. 9 is a diagram of circuitry for calculating the resistance of the patient's skin.

To continuously track the changing resistance of the patient's skin during treatment, the microprocessor unit 13 utilizes a circuit such as the one depicted in FIG. 9. With both voltage and current applied to the patient as known values, the resistance of the patient's skin can be calculated using the equation for resistance: $R=V/C$.

During the treatment cycle, the operator will monitor the force information being relayed to him via the personal computer 17, and monitor 19 to ensure that the pressure being applied to the patient's skin is within prescribed limits. It is important to maintain contact force within certain limits to maximize the accuracy of the resistance measurements calculated by the microprocessor unit 13. Vacillations in surface pressure lead to variation in the resistance readings on the patient's skin surface which will confuse the microprocessor unit 13 and personal computer 17 and will lead to sub-optimal treatment.

When introducing elements of the present invention of the preferred embodiments thereof, the articles "a", "an", "the" and "said" are intended to mean that there are one or more of the elements. The terms "comprising", "including", and "having" are intended to be inclusive and mean that there may be additional elements other than the listed elements.

In view of the foregoing, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A noninvasive electroacupuncture system comprising a source of electrical potential, a probe electrically connected to the electrical potential source and constructed for selectively contacting skin and applying the electrical potential to the skin, and a processing apparatus in communication with the probe and adapted to determine the electrical resistance of the skin, the processing apparatus storing a desired force range to be applied to the skin to achieve accurate determinations of electrical resistance of the skin, wherein the processing apparatus stores electric treatment parameters for acupuncture meridians and is programmed to control the electrical potential source to automatically provide the treatment parameter associated with a particular meridian based on a meridian selected for treatment, the probe comprising a housing, a plunger mounted in the housing for longitudinal travel with respect to the housing, the plunger being arranged to receive the force applied to the skin when the probe contacts but does not penetrate the skin, and a sensor for measuring the force received by the plunger and providing a signal indicative of the force measured, the plunger being mounted in the housing for movement relative to the housing in response to manually applied force on the housing to move the plunger against the skin.

2. An electroacupuncture system as set forth in claim 1 further comprising an output device operatively connected to the probe for outputting a communication perceptible by humans of the force being applied.

3. An electroacupuncture system as set forth in claim 2 wherein the output device comprises a monitor adapted to visually display an indication of the force applied.

4. An electroacupuncture system as set forth in claim 2 wherein the output device comprises an audio output capable of outputting a sound indicative of how close the force applied to the skin is to a selected force.

5. An electroacupuncture system as set forth in claim 2 wherein the output device is constructed to indicate both forces applied to the skin above and below a selected force, and where such device provides continuous measurement of force.

6. An electroacupuncture system as set forth in claim 1 wherein the processing apparatus is adapted to repeatedly receive input of a desired force range to be applied to the skin by the probe.

7. An electroacupuncture system as set forth in claim 1 wherein the processing apparatus is programmed to measure resistance only when the force being applied to the skin as measured by the sensor lies within the desired force range.

8. An electroacupuncture system as set forth in claim 1 wherein the processing apparatus is adapted to calculate electrical resistance of the skin, monitor the changes in electrical resistance, and stop the application of electrical potential from the source when the electrical resistance reaches a predetermined level.

9. An electroacupuncture system as set forth in claim 1 wherein the plunger has a distal end and a proximal end, the probe further comprising a spring located at the distal end and biasing the plunger in a direction outward of the probe housing.

10. An electroacupuncture system as set forth in claim 9 wherein the plunger further comprises a cavity opening outward at the proximal end of the plunger and receiving the spring therein, the probe further comprising a plug slidably received in the cavity, engaged with the spring and engaged with the sensor for transmitting force from the plunger to the sensor.

11. An electroacupuncture system as set forth in claim 10 wherein the plunger comprises a receptacle for replaceably receiving a tip.

12. An electroacupuncture system as set forth in claim 1 wherein the plunger is operatively connected to the sensor.

13. An electroacupuncture system as set forth in claim 1 wherein the probe further comprises a button for selectively activating application of the electrical potential through the probe.

14. A noninvasive electroacupuncture system comprising:

a source of electrical potential;

a probe electrically connected to the electrical potential source and constructed for selectively contacting skin and applying the electrical potential to the skin the probe comprising a housing, a plunger mounted in the housing for longitudinal travel with respect to the housing, the plunger being arranged to receive the force applied to the skin when the probe contacts but does not penetrate the skin, and a sensor for measuring the force received by the plunger and providing a signal indicative of the force measured, the plunger being mounted in the housing for movement relative to the housing in response to manually applied force on the housing to move the plunger against the skin;

a processing apparatus in communication with the probe, wherein the processing apparatus stores a desired force to be applied to the skin by the probe, the processing apparatus being adapted to determine the electrical resistance of the skin, the processing apparatus being programmed to measure resistance only when the force being applied to the skin as measured by the sensor corresponds to the desired force; and wherein the electroacupuncture system is adapted to apply a relatively lower current to the skin during a diagnostic mode to measure resistance of the skin, to determine meridian imbalances and calculate a treatment, to apply a relatively higher current to the skin during a treatment mode to alter the resistance of the skin according to the calculated treatment, and to cease application of electrical potential to the skin during the treatment mode when a predetermined electrical resistance of the skin is reached and any meridian imbalances have been corrected.

* * * * *